United States Patent [19]

Arawaka et al.

[11] Patent Number: 4,748,535

[45] Date of Patent: May 31, 1988

[54] METHOD OF MAGNETIZING ROTOR OF MOTOR

[75] Inventors: Noriaki Arawaka, Tochigi; Kenichi Iizuka, Ashikaga; Hideo Uzuhashi, Tochigi; Masahiko Sugiyama, Nirasaki; Akihisa Hamaguchi, Kyoto; Takashi Seshita, Tochigi, all of Japan

[73] Assignee: Hitachi, Ltd., Tokyo, Japan

[21] Appl. No.: 9,292

[22] Filed: Jan. 30, 1987

[30] Foreign Application Priority Data

Mar. 5, 1986 [JP] Japan ..... 61-46117

[51] Int. Cl.[4] ..... H01F 13/00; H01F 7/20

[52] U.S. Cl. ..... 361/148; 335/284

[58] Field of Search ..... 361/143, 147, 148; 335/284

[56] References Cited

U.S. PATENT DOCUMENTS 1,515,500 11/1924 Lee ..... 335/284

4,381,492 4/1983 Steingroever et al. ..... 335/284

FOREIGN PATENT DOCUMENTS 57-142165 2/1981 Japan .

*Primary Examiner*—L. T. Hix

*Assistant Examiner*—David Porterfield

*Attorney, Agent, or Firm*—Antonelli, Terry & Wands

[57] ABSTRACT

A method of magnetizing a rotor of a motor including the rotor made of an integrated magnet member and a stator is provided. Predetermined magnetic fields are preliminarily applied to the rotor to form magnetic paths and thereafter, the rotor is demagnetized. Then, the rotor is assembled into the stator. The rotor and stator are positioned such that the directions of the magnetic fields which are generated from the stator winding of the stator coincide with the directions of the magnetic paths of the rotor. Subsequently, in the state in which both of the rotor and stator are positioned, a current is supplied to the stator winding and the magnetic fields are generated, thereby magnetizing the rotor by the magnetic fields.

6 Claims, 3 Drawing Sheets

METHOD OF MAGNETIZING ROTOR OF MOTOR

BACKGROUND OF THE INVENTION

The present invention relates to a magnetizing method of a rotor of a motor and, more particularly, to a method of magnetizing a motor in which an integrated type magnet member using no yoke member is used as a rotor.

A conventional permanent magnet rotor consists of divided magnets 2 as many as only the number of poles (four poles) which are arranged around a yoke 1 as shown in FIG. 1. A magnetic path 3 of each magnet 2 is orientated toward the center of the yoke 1 as shown by a broken line. The rotor having such a constitution is disclosed in, for example, JP-A 57-142165 filed in Japan by Hitachi, Ltd. on Feb. 26, 1981.

After each of the magnet 2 split type rotors were individually worked, they are fixedly attached to the outer peripheral portion of the yoke 1. Therefore, there are the following problems. Namely, the magnets 2 need to be uniformly worked and the surfaces of the yoke 1 which are come into contact with the magnets 2 also need to be worked at a high degree of accuracy, respectively. Further, the divided magnets 2 need to be fixedly positioned to the yoke 1 so as not to move therefrom. Therefore, there is a problem such that if such requirements are intended to be satisfied, the mass productivity of the rotors deteriorates. Moreover, in the case of fixing the split type magnets 2 to the yoke 1, there is a problem such that a gap portion d is caused between the magnets 2 due to a variation in assembly accuracy as shown in FIG. 2, so that the magnetic characteristics of the magnets deteriorate and the performance of the motor deteriorates.

To solve the foregoing problems, a constitution in which an integrated magnet of the polar anisotropic dry type using no yoke is used as the rotor has been examined. According to this magnet, magnetic paths 5 shown by broken lines in a rotor 4 are formed in only the magnet as shown in FIG. 3.

In the case of manufacturing a closed type compressor including a motor therein, if the magnetized magnets are preliminarily assembled to the motor, there is a possibility such that the metal particles deposited onto the magnets during the assembly process causes the sintering of the compressor. To avoid this, after the non-magnetized rotor was assembled to the motor in the compressor housing, it is necessary to allow a current to flow through the stator winding and to magnetize the magnet parts of the rotor by the magnetic fields which are induced by the current flowing through the stator winding. This is a serious problem in the apparatus such that the metal particles deposited to the rotor exerts an influence on a load apparatus of the motor.

In the case of magnetizing the integrated non-magnetized magnet rotor of the polar anisotropic dry type by the magnetic fields which are generated from the stator by supplying a current to the stator winding, if the directions of the stator magnetic fields are not coincident with the directions of the magnetic paths of the magnet rotor, the magnetic flux will be weakened in the portions where the magnetic fields and magnetic paths cross each other, so that even if the magnet rotor is magnetized, a desired motor performance cannot be obtained.

SUMMARY OF THE INVENTION

It is an object of the present invention to solve the foregoing problems and to provide a method of magnetizing a rotor of a motor whereby a good motor characteristic can be derived.

It is another object of the invention to provide a method of magnetizing a rotor of a motor using a rotary compressor as a load.

The above objects are accomplished by a method whereby after an integrated magnet rotor formed with predetermined magnetic paths was combined with a stator, a current is supplied to a stator winding from a magnetizing power supply, the directions of the magnetic fields which are generated by the stator are made to coincide with the directions of the magnetic paths of the rotor, and thereby magnetizing the rotor in this state.

DESCRIPTION OF THE PREFERRED EMBODIMENTS

Figure 1:
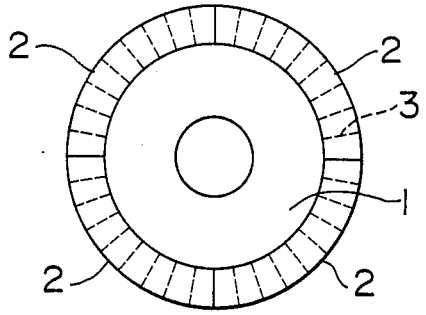
FIGS. 1 and 2 are vertical sectional views of rotors using conventional split type magnets, respectively.
Figure 2:
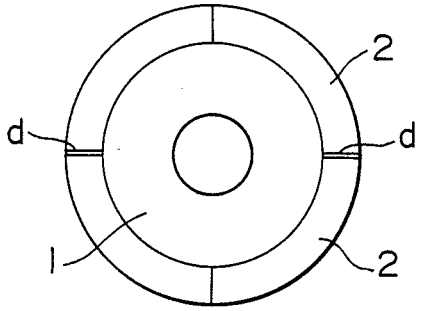
Figure 3:
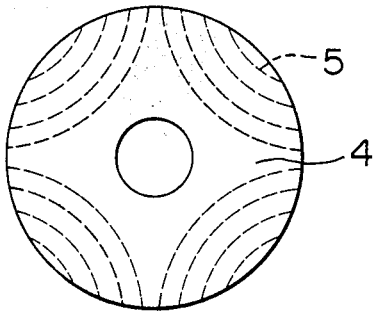
FIG. 3 is a vertical sectional view showing magnetic paths of a rotor of an integrated magnet according to the present invention.
Figure 4:
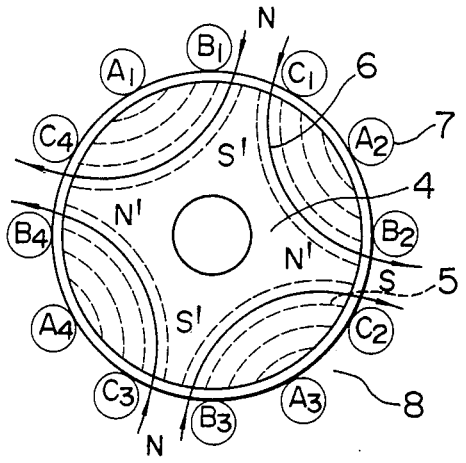
FIG. 4 is a diagram showing the positional relation between the winding magnetomotive forces which are generated in a stator winding in an embodiment of the invention and the magnetic paths of an integrated magnet of the polar anisotropic dry type in the rotor.

An embodiment of the present invention will now be described hereinbelow with reference to the drawings. FIG. 4 is a diagram showing the positional relation between the stator magnetic fields which are generated by supplying a current to a stator winding when an integrated rotor of the polar anisotropic dry type is magnetized and the magnetic paths of the rotor. Magnetic fields 6 are generated by supplying a current to a stator winding 7. The magnetic fields 6 have the same shapes as the magnetic fields which are formed in the rotor 4 after it was magnetized. The stator winding 7 is connected like a star shape of three phases of A, B, and C phases. In this embodiment, the stator winding 7 is wound so as to have four poles. Reference numeral 4 denotes the integrated magnet rotor of the polar anisotropic dry type and 5 indicates the magnetic paths. When the rotor 4 is molded before it is sintered, the magnetic fields of the same shape as that of the magnetic fields 6 which are generated from the stator winding 7 are applied from the outside to the rotor 4, thereby forming the magnetic paths 5.

Figure 5:
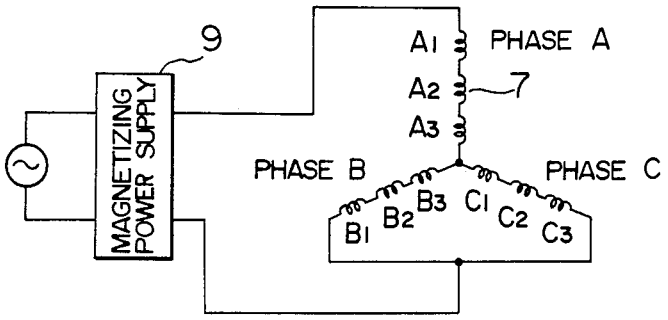
FIG. 5 is a connection diagram of a magnetizing power supply and the stator winding.

Although the rotor 4 is magnetized when the magnetic paths 5 are formed, the rotor is substantially demagnetized by the sintering. Therefore, the rotor 4 in the demagnetized state is assembled in a stator 8. N and S denote magnetic poles generated in the stator 8 and N′ and S′ represent magnetic poles magnetized in the rotor 4 in correspondence to the magnetic poles N and S. FIG. 5 is a connection diagram of a magnetizing power supply and the stator winding 7. In this embodiment, since the stator winding 7 has a three-phase star connection, when it is connected as shown in FIG. 5 and a current is supplied to the stator winding 7, the magnetic fields which are generated in the winding will be as shown by solid lines 6 in FIG. 4. The rotor 4 and stator 8 are positioned such that the directions of the magnetic paths 5 and magnetic fields 6 which are formed in the rotor 4 are coincident as shown in FIG. 4. After they were properly positioned, a current is supplied to the stator winding 7, thereby magnetizing the rotor 4 in the following manner.

As shown in FIG. 5, two phases of the stator winding 7 which was three-phase star connected are short-circuited, then the stator winding 7 is connected to a magnetizing power supply 9 (in this embodiment, B and C phases are short-circuited). Thereafter, the magnetizing voltage of some hundreds of volts and the magnetizing current of some hundreds of amperes are supplied from the magnetizing power supply 9 to the stator winding for the period of time of tens of msec. Thus, as shown by the solid lines in FIG. 4, the large magnetic fields 6 are generated in the stator winding 7 and the rotor 4 is magnetized (this embodiment, however, relates to the magnetization in the case of the four-pole motor).

The values of the magnetizing current and voltage and the magnetizing time mentioned above as examples are determined on the basis of the turn number of the stator winding and currents so as to obtain desired strength of magnetizing magnetic fields. A well-known capacitor discharging type DC power supply may be used as the magnetizing power supply 9.

It is sufficient to write a mark to the rotor 4 and to position the rotor 4 and stator 8 on the basis of this mark. According to the magnet rotor magnetized by the foregoing method, the magnetic poles are magnetized such that the magnetic fields are formed so as to coincide with the magnetic paths of the rotor. Therefore, the magnetic poles can be easily magnetized and the magnetic flux of a desired magnitude can be obtained and the characteristic of the motor can be improved.

Figure 6:
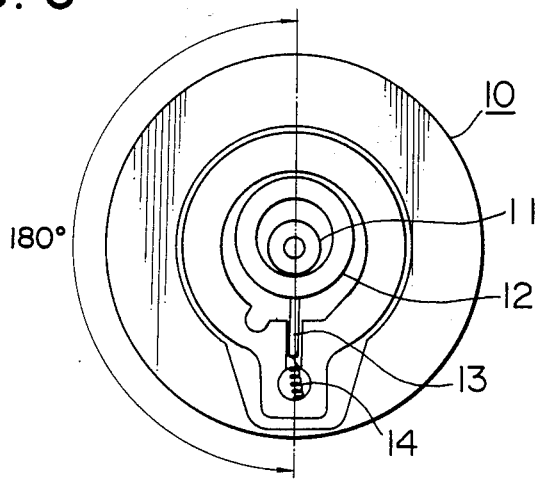
FIG. 6 is a vertical sectional view of a rotary unit.
Figure 7A:
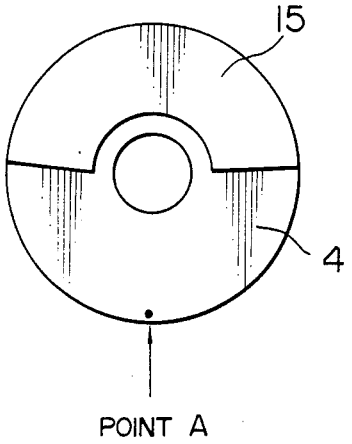
FIGS. 7(A) and 7(B) are diagrams showing the positional relation between the magnetic paths of a magnet rotor and a balance weight.
Figure 7B:
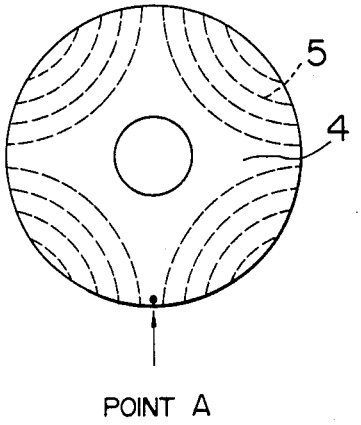
Figure 8:
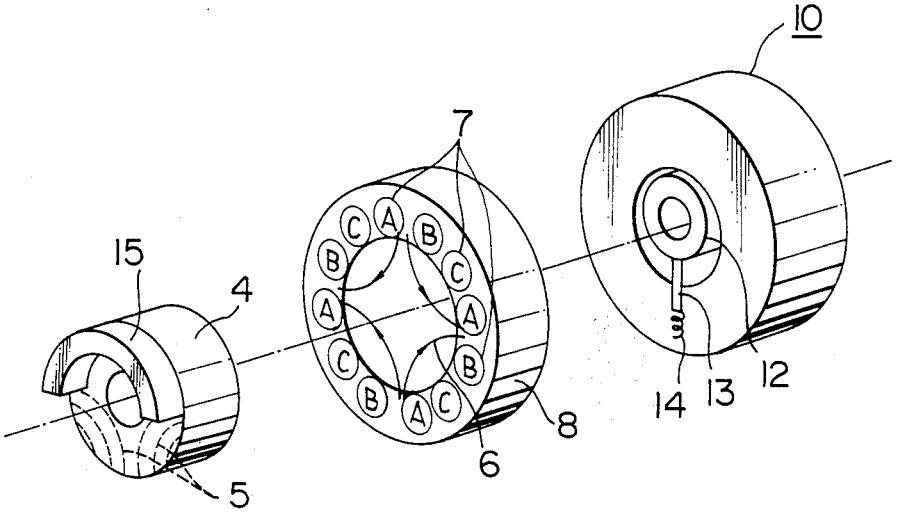
FIG. 8 is a diagram showing the positional relation among the rotor, the stator, and the rotary unit.

An example of application of the magnetization when a load was applied to an output terminal of the motor will now be described by an embodiment of a rotary compressor shown in FIGS. 6 to 8. FIG. 6 is a vertical sectional view of a rotary unit 10 of a rotary compressor. A rotary shaft 11 is connected to the rotor 4 of the motor. The rotation of the rotary shaft 11 is transferred to a roller 12 by the frictional force, thereby allowing the roller 12 to eccentrically rotate. Since the magnetization is performed by the compressor assembly, no refrigerant is contained in the compressor. Therefore, almost of the load to be applied to the rotor 4 when it is assembled is the spring force of a spring 14 to press a vane 13 adapted to come into contact with the roller 12. Thus, the roller 12 is rotated so as to obtain the state in which the spring 14 is completely extended, which state corresponds to the position at which the load is the lightest. When the roller 12 is located in this state, the roller 12 stands still by the pressing force of the spring 14. In the case of practically assembling the rotor 4 into the rotary compressor, as shown in FIGS. 7(A) and 8, a balance weight 15 is attached to the rotor 4 in order to cancel the unbalance of the rotary unit. The embodiment intends to clarify the positions of the magnetic paths 5 of the rotor 4 by the balance weight 15 and to enable the rotor 4 to be certainly and easily magnetized such that the magnetic fields 6 overlap the magnetic paths 5. The positional relation between the magnetic paths 5 of the magnet rotor 4 and the balance weight 15 is as shown in FIGS. 7(A) and 7(B). Namely, the balance weight 15 is attached to the rotor 4 so that the relative positions between the positions of the magnetic paths 5 of the magnet rotor 4 and the balance weight 15 are matched on the basis of a point A as a reference point. The rotor 4 is assembled in the stator 8 of the motor in the compressor. In this case, the positions of the magnetic fields 6 which are generated by supplying a current to the stator winding 7 and of the magnetic paths 5 of the integrated magnet rotor 4 of the polar anisotropic dry type are matched on the basis of the point A as the reference point. At the same time, the state in which the spring 14 of the rotary unit 10 is completely extended, namely, the position at which the roller 12 is not rotated by the pressing force of the spring 14 which is applied to the roller 12 through the vane 13 is set. Thus, the rotor 4 connected to the roller 12 is not moved. Therefore, when a current is supplied to the stator winding 7 by the magnetizing power supply 9 in this state, the magnetic fields 6 are generated in the stator 8 so as to overlap the magnetic paths 5 of the rotor 4. Thus, the magnetic poles are magnetized to the rotor 4 so as to form the magnetic fields which overlap the magnetic paths 5. As described above, by magnetizing the magnetic poles such as to allow the magnetic fields to overlap the magnetic paths 5, i.e., such as to form the magnetic fields of substantially the same shape and at substantially the same position as those of the magnetic paths 5, the magnetization can be easily performed. Therefore, it is possible to provide a compressor having a motor in which the magnetic flux of a predetermined size is obtained and the motor characteristic is good.

We claim:

1. A method of magnetizing a rotor in a motor assembly including said rotor made of an integrated magnet member and a stator having a stator winding, comprising the steps of:

magnetizing said integrated magnet member to form magnetic paths in predetermined directions by applying magnetic fields thereto, said integrated magnet member forming said rotor;

demagnetizing said magnetized integrated magnet member to completely remove a magnetic force from said magnet member;

assembling said rotor of said integrated magnet member into said stator;

aligning the directions of magnetic fields which are generated by supplying a current to said stator winding of said stator with the directions of the magnetic paths of said demagnetized integrated magnet member of said rotor; and supplying a current to said stator winding in the state in which the directions of the magnetic fields are coincident with the directions of the magnetic paths of said integrated magnet member of said rotor, thereby magnetizing said rotor.

2. A magnetizing method according to claim 1, wherein the step of aligning the directions includes making a reference position of said rotor coincident with a reference position of said stator.

3. A magnetizing method according to claim 2, wherein said reference position of said rotor is a position for specifying the directions of the magnetic paths of said integrated magnet member of said rotor, and said reference postion of said stator is a position for specifying the directions of the magnetic fields.

4. A method of magnetizing a rotor in a motor assembly using a rotory compressor as a load, said motor including said rotor made of an integrated magnet member and stator having a stator winding, said method comprising the steps of:

magnetizing said integrated magnet member to form magnetic paths in predetermined directions by applying magnetic fields thereto, said integrated magnet member forming said rotor;

demagnetizing said magnetized integrated magnet member to completely remove a magnetic force from said magnet member;

assembling said rotor, said stator and said rotary compressor;

aligning the directions of the magnetic fields which are generated by supplying a current to said stator winding of said stator in a state in which a rotary unit of said rotary compressor is stoppped with the directions of the magnetic paths of said demagnetized integrated magnet member of said rotor; and supplying a current to said stator winding in the state in which the directions of the magnetic fields are coincident with the directions of the magnetic paths of said integrated magnet member of said rotor, thereby magnetizing said rotor.

5. A magnetizing method according to claim 4, wherein the step of aligning the directions includes making a reference position of said rotor coincident with a reference position of said stator.

6. A magnetizing method according to claim 5, wherein said reference position of said rotor is a predetermined position of a balancer attached to said rotor and indicative of a position for specifying the directions of the magnetic paths, and said reference position of said stator is a position for specifying the directions of the magnetic fields.

* * * * *